United States Patent [19]

Clumpner

[11] 4,177,065

[45] Dec. 4, 1979

[54] METHOD FOR THE DEGASSING AND FILTRATION OF MOLTEN METAL

[75] Inventor: Joseph A. Clumpner, Creve Coeur, Mo.

[73] Assignee: Swiss Aluminium Ltd., Chippis, Switzerland

[21] Appl. No.: 2,843

[22] Filed: Jan. 12, 1979

Related U.S. Application Data

[62] Division of Ser. No. 914,511, Jun. 12, 1978.

[51] Int. Cl.[2] ..... C22B 9/02; C22B 9/08

[52] U.S. Cl. ..... 75/93 E; 75/68 R

[58] Field of Search ..... 75/68 R, 93 E, 93 R

[56] References Cited

U.S. PATENT DOCUMENTS

| | | | |
|---|---|---|---|
| 3,311,467 | 3/1967 | Polishouk et al. | 266/215 X |
| 4,052,199 | 10/1977 | Mangalick | 75/93 E |

*Primary Examiner*—M. J. Andrews

*Attorney, Agent, or Firm*—Bachman and LaPointe

[57] ABSTRACT

The disclosure teaches an improved method and apparatus for the treatment of liquids with gases and especially for use in the degassing and filtration of molten metal, especially aluminum, using an apparatus which employs a swirling tank reactor. The swirling tank reactor is in the form of a substantially cylindrical chamber and is characterized by having a liquid inlet at the top thereof and at least one gas inlet at the bottom of said substantially cylindrical chamber wherein at least either the liquid inlet or the gas inlet is positioned with respect to the wall of the cylidrical chamber for tangentially introducing either liquid or gas such that the liquid swirlingly flows from said liquid inlet to a liquid outlet. In a preferred embodiment for the degassing and filtration of molten metal, a filter-type medium is positioned beneath said molten metal inlet to filter the molten metal prior to delivering the same to a casting station. Dissolved gases and non-metallic inclusions are thereby abstracted and removed from the melt.

3 Claims, 4 Drawing Figures

METHOD FOR THE DEGASSING AND FILTRATION OF MOLTEN METAL

This is a division of application Ser. No. 914,511, filed June 12, 1978.

BACKGROUND OF THE INVENTION

The present invention relates to the treatment of liquids with gases and more particularly to the degassing of molten metal. Molten metal, particularly molten aluminum in practice, generally contains entrained and dissolved impurities both gaseous and solid which are deleterious to the final cast product. These impurities may affect the final cast product after the molten metal is solidified whereby processing may be hampered or the final product may be less ductile or have poor finishing and anodizing characteristics. The impurities may originate from several sources. For example, the impurities may include metallic impurities such as alkaline and alkaline earth metals and dissolved hydrogen gas and occluded surface oxide films which have become broken up and are entrained in the molten metal. In addition, inclusions may originate as insoluble impurities such as carbides, borides and others or eroded furnace and trough refractories.

One process for removing gaseous impurities from molten metals is by degassing. The physical process involves injecting a fluxing gas into the melt. The hydrogen enters the purged gas bubbles by diffusing through the melt to the bubble where it adheres to the bubble surface and is adsorbed into the bubble itself. The hydrogen is then carried out of the melt by the bubble.

It is naturally highly desirable to improve the degassing of molten metals in order to remove or minimize such impurities in the final cast product, particularly with respect to molten aluminum and especially, for example, when the resultant metal is to be used in a decorative product such as a decorative trim or products bearing critical specifications such as aircraft forgings and extrusions and light gauge foil stock. Impurities as aforesaid cause loss of properties such as tensile strength and corrosion resistance in the final cast product.

Rigorous metal treatment processes such as gas fluxing or melt filtration have minimized the occurrence of such defects. However, while such treatments have generally been successful in reducing the occurrence of such defects to satisfactory levels, they have been found to be inefficient and/or uneconomical. Conventionally conducted gas fluxing processes such as general hearth fluxing have involved the introduction of the fluxing gas to a holding furnace containing a quantity of molten metal. This procedure requires that the molten metal be held in the furnace for significant time while the fluxing gas is circulated so that the metal being treated would remain constant and treatment could take place. This procedure has many drawbacks, among them, the reduced efficiency and increased cost resulting from the prolonged idleness of the furnace during the fluxing operation and more importantly, the lack of efficiency of the fluxing operation due to poor coverage of the molten metal by the fluxing gas which is attributable to the large bubble size and poor bubble dispersion within the melt. Further factors comprise the restriction of location to the furnace which permits the re-entry of impurities to the melt before casting, and the high emissions resulting from both the sheer quantity of flux required and the location of its circulation.

As an alternative to the batch-type fluxing operations employed as aforesaid, certain fluxing operations were employed in an inline manner; that is, the operation and associated apparatus were located outside the melting or holding furnace and often between the melting furnace and either the holding furnace or the holding furnace and the casting station. This helped to alleviate the inefficiency and high cost resulting from furnace idleness when batch fluxing but was not successful in improving the efficiency of the degassing operation itself, in that the large size of the units and the undesirably large quantities of fluxing gas required per unit of molten metal were both costly and detrimental to air purity.

A typical inline gas fluxing technique is disclosed in U.S. Pat. No. 3,737,304. In the aforenoted patent, a bed of "stones" is positioned in a housing through which the molten metal will pass. A fluxing gas is introduced beneath the bed and flows up through the spaces between the stones in counter flow relationship with the molten metal. The use of a bed of porous "stones" has an inherent disadvantage. The fact that the stones have their pores so close together results in the bubbles passing through the stones coalescing on their surfaces and thus creating a relatively small number of large bubbles rather than a large number of small bubbles. The net effect of the bubbles coalescing is to reduce the surface area of bubble onto which the hydrogen can be adsorbed thus resulting in low degassing efficiency.

One improved method and apparatus for the inline degassing and filtration of molten metal is disclosed in U.S. Pat. No. 4,052,198 to Yarwood et al. and assigned to the assignee of the present invention. The disclosure teaches an improvement in the degassing and filtration of molten metal using an apparatus which employs a pair of sequentially placed, removable filter-type elements and at least one fluxing gas inlet positioned therebetween. The fluxing gas is introduced into the melt through the inlet and flows through the first of said plates in countercurrent contact with the melt. The filter plate serves to break up the fluxing gas into a fine dispersion to insure extensive contact with the melt. The filter plates employed are made of porous ceramic foam materials which are useful for the filtration of molten metal for a variety of reasons included among which are their excellent filtration efficiencies resulting from their uniform controllable pore size, low cost as well as ease of use and replaceability. The ceramic foam filters are convenient and inexpensive to prepare and easily employed in an inline degassing and filtration unit.

While the aforenoted U.S. Pat. No. 4,052,198 offers significant improvements over those inline gas fluxing techniques previously known in the art, a number of problems have been encountered. It is desirable for economic advantages and increased productivity to have degassing and filtration systems which can treat molten metal continuously at a rate commensurate with the casting practices. The employment of known inline degassing units such as aforenoted U.S. Pat. No. 3,737,304 for continuous degassing and filtration have been found to be extremely inefficient, thus requiring large multiple chamber arrangements necessary to sufficiently treat the quantities of molten metal which are required for continuous casting operations. As a result of the large size of the treatment units, supplemental heating is required to prevent freeze up of the molten metal as it is being treated. While some improvement in the quantity of molten metal which can be treated has been achieved by using a smaller system such as that disclosed in U.S. Pat. No. 4,052,198 which utilizes ceramic filters and countercurrent gas flow, such a system has been found to have a limited effectiveness in the quantity of molten metal which can be treated due to the large pressure drops encountered in the simultaneous countercurrent flow of gas and metal through the filter body. As a result of the large pressure drop, a large head of molten metal is developed upstream of the filter element thus requiring either an increase in size of the transfer passageway upstream of the filter element or a decrease in the rate of feeding the molten metal to the treatment unit. In addition to the limited effectiveness of the quantity of molten metal which can be treated in the aforenoted U.S. patent, it has been found that the efficiency of the degassing process leaves much to be desired since it has been found that the fluxing gas bubbles tend to coalesce thereby limiting the efficiency of the kinetics of the adsorption reaction.

Accordingly, it is a primary object of the present invention to provide an improved method and apparatus for treating liquids with gases.

It is the principal object of the present invention to provide an improved method and apparatus for the degassing and filtration of molten metal which utilizes a substantially cylindrical swirling tank reactor characterized by tangential inlets for either and/or both the molten metal and the fluxing gas.

It is a particular object of the present invention to provide an improved fluxing gas inlet which minimizes fluxing gas bubble coalescence.

It is still a further object of the present invention to provide an improved filtering and degassing apparatus which allows for an increase in the quantity of molten metal which can be effectively treated.

It is still a further object of the present invention to provide improvements as aforesaid which are convenient and inexpensive to utilize and which result in highly efficient degassing and filtration.

Further objects and advantages of the present invention will appear hereinbelow.

SUMMARY OF THE INVENTION

In accordance with the present invention, the foregoing objects and advantages are readily obtained.

The present invention comprises an improved method and apparatus for treating liquids with gases and more specifically for use in the degassing and filtration of molten metal, especially aluminum. A preferred embodiment of the present invention comprises a highly efficient degassing and filtration apparatus comprising an elongated substantially cylindrical chamber having a metal inlet at the top thereof and a metal outlet at the bottom. While in the preferred embodiment the chamber is shown as being cylindrical, it should be appreciated that the shape of the chamber could be in an octagon shape or the like as long as the shape allows the metal to flow in a swirling rotating fashion as it passes from the inlet of the chamber to the outlet thereof. In the preferred embodiment, a plurality of fluxing gas inlet nozzles are located in the chamber wall below the metal inlet and preferably between the metal inlet and the metal outlet. In order to achieve the desired swirling flow of molten metal from the metal inlet to the metal outlet, it is a requirement that either the metal inlet or the fluxing gas inlets are positioned with respect to the cylindrical chamber wall so as to tangentially introduce either the liquid or the gas. If only one of the inlets are so positioned, it is preferred that it be the metal inlet. It is preferred that both the liquid and gas are tangentially introduced and therefore the metal inlet and fluxing gas nozzles are located with respect to the tangents of points on the outer circumference of the cylindrical chamber wall so as to tangentially inject the metal and fluxing gas in the same direction such that the molten metal swirlingly flows into the chamber through the metal inlet down to the outlet. By injecting the fluxing gas into a swirlingly rotating metal stream, the dispersion of the degassing bubbles is maximized and thus by optimizing nozzle size the effective adsorption of gaseous impurities is increased. In the preferred embodiment, a filter-type medium provided with an open cell structure characterized by a plurality of interconnected voids is positioned in the cylindrical chamber between the metal inlet and the metal outlet and ideally downstream of the fluxing gas inlet nozzles. When the cylindrical degassing chamber is used in combination with a filter-type medium, the position of the metal outlet at the bottom of the chamber is not material. However, if the degassing chamber is used without a filter medium, it is preferred that the metal outlet be tangentially located so as to assist in the swirling movement of the molten metal as it travels from the inlet to the outlet.

In accordance with the method of the present invention, degassing of molten metal is conducted by passing the metal through the cylindrical chamber from the metal inlet to the metal outlet wherein the metal is brought into swirling contact with a fluxing gas while the metal flows downwardly as it continues to rotate until it finally leaves the chamber through the outlet.

The method of the present invention may employ a fluxing gas such as an inert gas, preferably carrying a small quantity of an active gaseous ingredient such as chlorine or a fully halogenated carbon compound. The gas used may be any of the gases or mixtures of gases such as nitrogen, argon, chlorine, carbon monoxide, Freon 12, etc., that are known to give acceptable degassing. In the preferred embodiment for the degassing of molten aluminum melts, mixtures of nitrogen-Freon 12 or argon-Freon 12 are used. In addition, an inert gaseous cover such as argon, nitrogen, etc., may be located over the surface of the molten metal to minimize the readsorption of gaseous impurities at the surface of the melt.

The present apparatus and method provide a considerable increase in productivity in the degassing of molten metal as degassing is continued without interruptions of the melting furnace. Further, the design of the apparatus enables its placement near to the casting station whereby the possibility of further impurities entering the melt are substantially eliminated. The employment of the method and apparatus of the present invention provides a considerable improvement in the degassing of molten metal by optimizing the efficiency of the adsorption of the gaseous impurities.

The apparatus of the present invention minimizes the bubble size of the purged gas while maximizing the gas bubble density thereby increasing the effective surface area for carrying out the adsorption reaction thus optimizing the degassing of the molten metal.

In addition, the efficiency of the present invention permits degassing to be conducted with a sufficiently lower amount of flux material whereby the level of effluence resulting from the fluxing operation is greatly reduced.

By virtue of the employment of a filter-type medium within the cylindrical chamber, the apparatus and method of the present invention are capable of achieving levels of melt purity heretofore attainable only with the most rigorous of processing.

DETAILED DESCRIPTION

Figure 1:
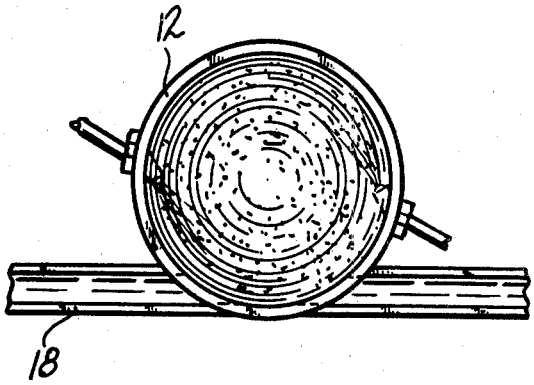
FIG. 1 is a schematic top view of the apparatus of the present invention used for the degassing and filtration of molten metal.
Figure 4:
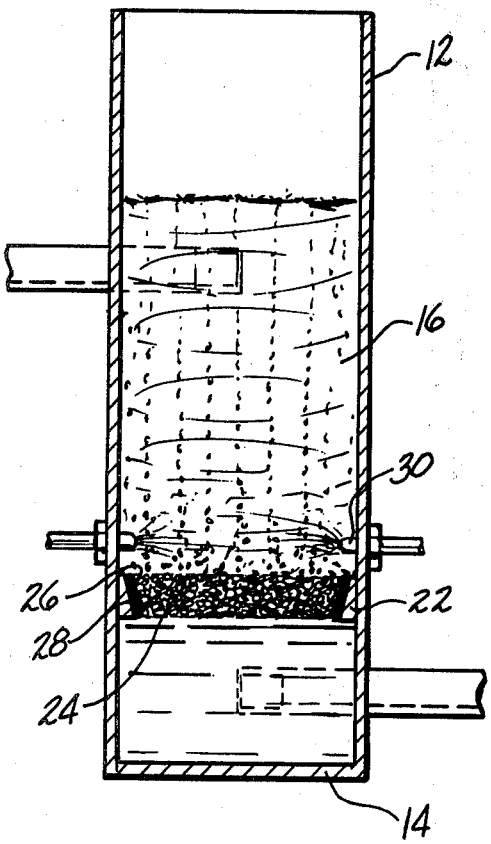
FIG. 4 is a schematic sectional view of the apparatus of the present invention.
Figure 2:
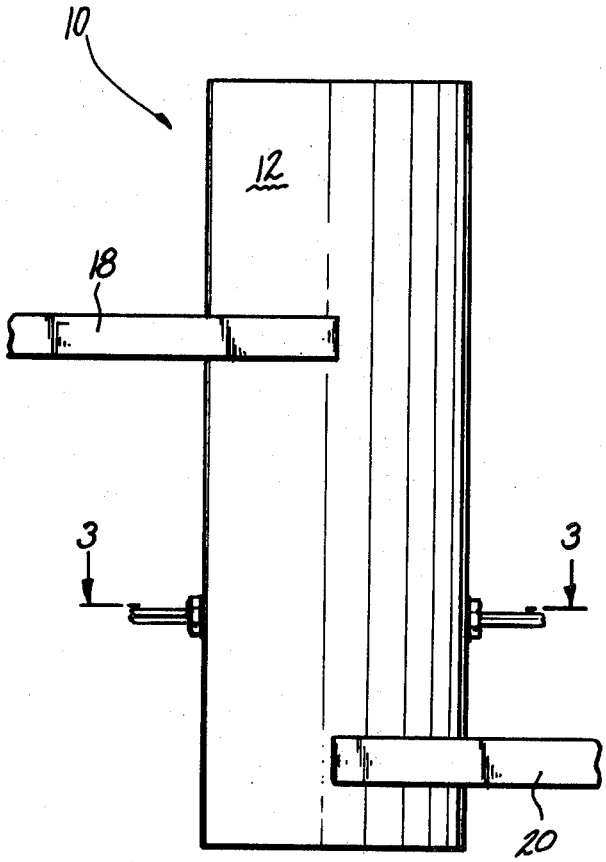
FIG. 2 is a schematic side view of the apparatus of the present invention.

Referring to the figures, the apparatus is illustrated in location with a molten metal transfer system which may include pouring pans, pouring troughs, transfer troughs, metal treatment bays or the like. The apparatus and method of the present invention may be employed in a wide variety of locations occurring intermediate the melting and casting stations in the metal processing system. Thus, FIGS. 1 and 2 illustrate a refractory swirling tank reactor 10 comprising an elongated cylindrical side wall 12 and a bottom wall 14 which form degassing and filtration cylindrical chamber 16. Molten metal tangentially enters cylindrical chamber 16 through inlet launder 18 at the top of cylindrical chamber 16 and exits therefrom through outlet launder 20. In the preferred embodiment illustrated in the drawings, the outlet 20 is shown to be tangential, however, it should be noted that a tangential outlet is of little consequence when a filter medium is used in the apparatus. An inert gaseous cover such as argon, nitrogen, etc., not shown, is provided over the top of chamber 16 so as to minimize the readsorption of gaseous impurities at the surface of the molten metal. Cylindrical side wall chamber 12 is provided with a peripheral rim 22 positioned upstream of outlet means 20 and in proximate location therewith. The peripheral rim 22 as illustrated in FIG. 4 defines a downwardly converging bevelled surface which enables for the installation and replacement of an appropriately configured filter-type medium 24. The filter-type medium 24 has a corresponding bevelled peripheral surface 26 provided with seal means 28 which is adapted to sealingly mate with peripheral rim 22 within cylindrical chamber 16.

In accordance with the preferred embodiment of the present invention, side wall 12 is provided on its circumference with a plurality of fluxing gas inlet nozzles 30 located above filter-type medium 24 for tangentially introducing a fluxing gas into the molten metal as it passes through cylindrical chamber 16 from inlet 18 to outlet 20. It is a preferred feature of the present invention that the fluxing gas and molten metal be introduced into cylindrical chamber 16 in the same directional flow, i.e., clockwise or counterclockwise, so that the molten metal will continuously swirl in chamber 16 as it travels from inlet 18 to outlet 20. However, as noted previously, it is only necessary that an adequate swirling flow is generated and such may be achieved if either the metal or the gas is tangentially introduced under some circumstances.

In the preferred embodiment of the present invention, the use of a cylindrical degassing and filtration chamber in combination with a tangential metal inlet and tangential fluxing gas inlets has a distinct advantage over conventional methods and apparatuses for filtering and degassing molten metal. In accordance with the present invention, in order to optimize the efficiency of the degassing process; that is, maximize the efficiencies of the kinetics of the adsorption reaction, the introduction of the fluxing gas into the melt should be optimized so as to provide minimum bubble size and maximum bubble density while eliminating bubble coalescence. Thus, the orifice size of the nozzles should be controlled in order to minimize bubble size in order to maximize surface area for the adsorption reaction. The orifices are made as small as possible consistent with preventing plugging of the orifices with metal. The nozzles may be in the form of a straight tube, a converging type nozzle, or a supersonic converging-diverging nozzle. In accordance with the present invention, orifice sizes in the range of 0.005" to 0.075" have been successfully employed with the preferred size range being from 0.010" to 0.050". The bubble distribution throughout the melt as well as preventing bubble coalescence is controlled by the pressure at which the fluxing gas is introduced. Gas gauge pressures in the range of 5 psi to 200 psi, preferably greater than 20 psi, have been found optimum in the degassing of molten aluminum and its alloys.

The fluxing gas which may be employed in the present apparatus and method comprises a wide variety of well known components including chlorine gas and other halogenated gaseous material, carbon monoxide as well as certain inert gas mixtures derived from and including nitrogen, argon, helium or the like. A preferred gas mixture for use in the present invention for degassing molten aluminum and aluminum alloys comprises a mixture of nitrogen or argon with dichlorodifluoromethane from about 2 to about 20% by volume, preferably 5 to 15% by volume. In conjunction with this gas mixture, a gaseous protective cover of argon, nitrogen or the like may be used over the molten metal so as to minimize readsorption of gaseous impurities at the surface of the melt.

A preferred embodiment of the present invention calls for the provision of a filter-type medium positioned within the cylindrical chamber. Accordingly, the filter-type medium comprises a filter medium such as that illustrated in FIG. 4. The filter medium possesses an open cell structure, characterized by a plurality of interconnected voids, such that the molten metal may pass therethrough to remove or minimize entrained solids from the final cast product. Such a filter may comprise, for example, a solid filter medium made from sintered ceramic aggregate, or a porous carbon medium. In the preferred embodiment, a ceramic foam filter is utilized as described in U.S. Pat. No. 3,962,081 and may be prepared in accordance with the general procedure outlined in U.S. Pat. No. 3,893,917, both of which U.S. patents are incorporated herein by reference. In accordance with the teachings of said U.S. patents, the ceramic foam filter has an air permeability in the range of from 400 to $8,000 \times 10^{-7}$ cm$^2$, preferably from 400 to $2,500 \times 10^{-7}$cm$^2$, a porosity or void fraction of 0.80 to 0.95 and from 5 to 45 pores per linear inch, preferably from 20 to 45 pores per linear inch. The molten metal flow rate through the filter may range from 5 to 50 cubic inches per square inch of filter area per minute.

In the instance where the filter medium of the present invention is designed to be a throwaway item, it is essential to provide an effective means of sealing the filter medium. It is greatly preferred to seal the filter medium in place using a resilient sealing means as illustrated and discussed earlier, which peripherally circumscribes the filter medium at the bevelled portion thereof. The resilient sealing means should be non-wetting to the particular molten metal, resist chemical attack therefrom and be refractory enough to withstand the high operating temperatures. Typical seal materials utilized in aluminium processing include fibrous refractory type seals of a variety of compositions, as the following illustrative seals: (1) a seal containing about 45% alumina, 52% silica, 1.3% ferric oxide and 1.7% titania; (2) a seal containing about 55% silica, 40.5% alumina, 4% chromia and 0.5% ferric oxide; and (3) a seal containing about 53% silica, 46% alumina and 1% ferric oxide.

In a preferred embodiment, the nozzles employed in the present invention should be constructed of a refractory material resistant to molten metal. Suitable materials include but are not limited to graphite, alumina and the like.

Referring to FIG. 4, molten metal is delivered to a refractory swirling tank reactor 10 through tangential inlet launder 18 at the top of cylindrical chamber 16. Fluxing gas is introduced into the molten metal through nozzles 30 in the bottom of chamber 16, the fluxing gas being injected in the same direction as the molten metal is introduced into the chamber. The molten metal contents in chamber 16 flows downward to outlet launder 20 as it continues to swirl in the direction that the fluxing gas is introduced. As the molten metal passes through the chamber 16, the fluxing gas, depicted as a plurality of bubbles, flows upwardly through the melt in substantially countercurrent flow with the melt, the gaseous impurities diffuse through the melt, adhere to the fluxing gas bubble, are adsorbed into the bubble itself and are subsequently carried up to the surface as the bubbles percolate up through the melt thereby removing any impurities.

Figure 3:
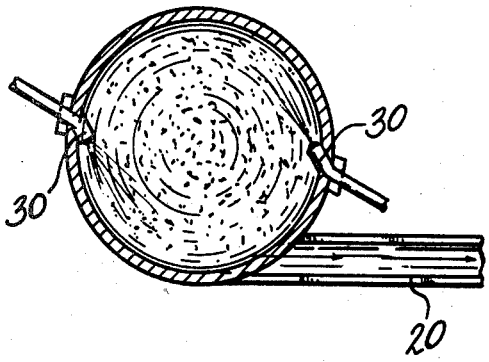
FIG. 3 is a schematic top view of the apparatus of the present invention taken along line 3—3 of FIG. 2.

The dimensions of the swirling tank reactor, the number of nozzles and the amount of fluxing gas employed depends greatly upon the flow rate of the metal to be treated. For typical commercial aluminum flow rates up to 2,000 pounds per minute the diameter of the swirling tank reactor may vary from 8" to 36" with the length of the chamber from the metal inlet to the metal outlet varying from 1' to 8'. A fluxing gas flow rate of from 0.5 cubic feet per minute to 12 cubic feet per minute has been found to be sufficient for the aforesaid metal flow rates. As the diameter of the swirling tank reactor chamber increases, the number of jets as well as the angle at which they inject fluxing gas into the melt correspondingly increase. Two nozzles are sufficient for cylinder diameters of 8" while it has been found that as many as six nozzles are required in order to get sufficient bubble dispersion in a 36" diameter chamber. The angles of the jet nozzles may vary from 10° to 90° as measured between the axes of the nozzles and the tangents of the points along the circumference of the wall portion of the cylinder through which the axes pass as the corresponding diameter of the cylinder increases from 8" to 36". The angle as measured is represented by the letter A in FIG. 3. It should be appreciated that when a plurality of nozzles are employed they need not be at the same angles. For cylinder diameters of 8", nozzle angles of 20°±5° have been found preferable while nozzle angles of 60°±10° have been successfully employed in cylinders of 18" diameter. Preferably the angle of the nozzles in less than 80° so as to more greatly assist in swirling the molten metal.

The following examples are illustrative of the present invention.

EXAMPLE I

A swirling tank reactor as illustrated in FIG. 1 having an internal chamber diameter of 8" was located in an existing molten metal transfer system. The distance between the metal inlet and metal outlet was 25" with the effective distance from the metal inlet to the nozzles being 18". A ceramic foam filter medium was disposed below the nozzle inlets and above the molten metal outlet. Two nozzles were employed having an orifice size of 0.025". The nozzles were positioned at an angle of 20° as taken from the tangent of the chamber wall. A melt of molten metal was passed through the fluxing box at a flow rate of 85 pounds per minute. A fluxing gas mixture of 10% by volume dichlorodifluoromethane in argon was introduced through the nozzles at a flow rate of 0.5 cubic feet per minute. Both the molten metal and fluxing gas were introduced in a counterclockwise direction when looking at the chamber from the top. The hydrogen content of the molten metal was measured both before and after treatment in a FMA tester. Under STP conditions, the hydrogen content was found to vary from 0.36 to 0.40 cc of hydrogen per 100 grams aluminum before treatment to 0.08 to 0.14 cc of hydrogen per 100 grams of aluminum after the degassing treatment thus representing an extremely efficient degassing operation.

EXAMPLE II

The same apparatus as previously described for Example I was employed. The molten metal flow rate through the swirling tank reactor was at a flow rate of 96 pounds per minute. A fluxing gas mixture of 10% by volume dichlorodifluoromethane in argon was introduced into the chamber at a flow rate of 0.5 cubic feet per minute. It was found that the hydrogen content as measured in a FMA tester varied from 0.35 to 0.38 cc of hydrogen under STP conditions per 100 grams aluminum to 0.10 to 0.12 cc of hydrogen per 100 grams aluminum. This again represents an extremely efficient degassing operation.

A wide variety of instances exist where the apparatus and method of the present invention in all of the above disclosed variations may be employed. Specifically in the instance of a continuous casting operation, a pair of flux filtration chambers may be employed in parallel arrangement. In such an operation, the great length and associated total flow of metal involved may require the changing of a filter medium in mid-run. Such changes may be facilitated by the employment of parallel flow channels each containing a chamber, together with a means for diverting flow from one channel to the other, by valves, dams or the like. Flow would thus be restricted to one chamber at a time and would be diverted to an alternate channel once the head drop across the first chamber became excessive. It can be seen that such a switching procedure could supply an endless stream of filtered metal to a continuous casting station.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for the degassing of molten metal by passing said molten metal through a chamber and purging said molten metal with a fluxing gas by passing said fluxing gas through said metal, the improvement comprising providing a chamber having an elongated side wall portion, providing said chamber with molten metal inlet means at a first height, molten metal outlet means at a second height below said first height and fluxing gas inlet means at a third height below said first height, tangentially positioning said molten metal inlet means with respect to said side wall portion such that said molten metal swirlingly flows in a clockwise or counterclockwise manner from said molten metal inlet to said molten metal outlet as said fluxing gas percolates through said molten metal.

2. The method of claim 1 comprising tangentially positioning said fluxing gas inlet.

3. The method of claim 2 comprising positioning said fluxing gas inlet means such that the axes thereof intersect said side wall portion at a plurality of points along the circumference thereof and form with the tangents of said points a plurality of angles.

* * * * *